US007322200B2

(12) United States Patent
Sorensen

(10) Patent No.: US 7,322,200 B2
(45) Date of Patent: Jan. 29, 2008

(54) METHOD AND DEVICE FOR COOLING PRODUCTS IN A TRANSPORT SYSTEM

(75) Inventor: Per Sorensen, Oslo (NO)

(73) Assignee: Zopa AS, Oslo (NO)

( * ) Notice: Subject to any disclaimer, the term of this patent is extended or adjusted under 35 U.S.C. 154(b) by 1270 days.

(21) Appl. No.: 10/332,816

(22) PCT Filed: Jul. 13, 2001

(86) PCT No.: PCT/NO01/00302

§ 371 (c)(1),
(2), (4) Date: Jan. 13, 2003

(87) PCT Pub. No.: WO02/05688

PCT Pub. Date: Jan. 24, 2002

(65) Prior Publication Data

US 2004/0026443 A1 Feb. 12, 2004

(30) Foreign Application Priority Data

Jul. 14, 2000 (NO) ..... 20003636

(51) Int. Cl.
*F25D 13/06* (2006.01)
*F25D 17/02* (2006.01)
*F25D 25/00* (2006.01)

(52) U.S. Cl. ..... 62/63; 62/374; 62/378; 221/150 R

(58) Field of Classification Search ..... 62/63, 62/255, 314, 374, 378, 455, 456; 221/211, 221/150 R, 251; 406/1, 2
See application file for complete search history.

(56) References Cited

U.S. PATENT DOCUMENTS 3,831,389 A * 8/1974 Lipona ..... 62/63
4,485,937 A 12/1984 Adams
4,645,035 A * 2/1987 Bavis ..... 186/37
4,984,939 A * 1/1991 Foreman et al. ..... 406/84
4,993,882 A * 2/1991 Nishizuka et al. ..... 406/31
5,299,891 A * 4/1994 Grosswiller et al. ..... 406/112
5,392,897 A * 2/1995 Akesaka ..... 198/604
5,586,686 A 12/1996 Bustos et al.

(Continued)

FOREIGN PATENT DOCUMENTS

EP 0 212 544 3/1987

(Continued)

*Primary Examiner*—Mohammad M. Ali
(74) *Attorney, Agent, or Firm*—Young & Thompson

(57) ABSTRACT

A device for cooling products (12) contained in a transport system, comprises at least one lead-down duct with an upper and a lower portion, where the upper portion is arranged to be supplied with products from a feeder device (21), and where the lower portion comprises a product outlet (33). The device is characterized in that at least one lead-down duct (31) is connected at or near its upper portion with a supply channel (41) for air provided from an external air cooling device (61). The lead-down duct (31) is preferably terminated at the lower portion by a termination piece (34) with at least one discharge opening, connected with a ventilation duct (35), and the ventilation duct (35) is preferably directly or indirectly connected to the intake (62) for the cooling device (61). The invention also relates to a method for cooling products contained in a transport system.

15 Claims, 3 Drawing Sheets

U.S. PATENT DOCUMENTS

Figure 1:
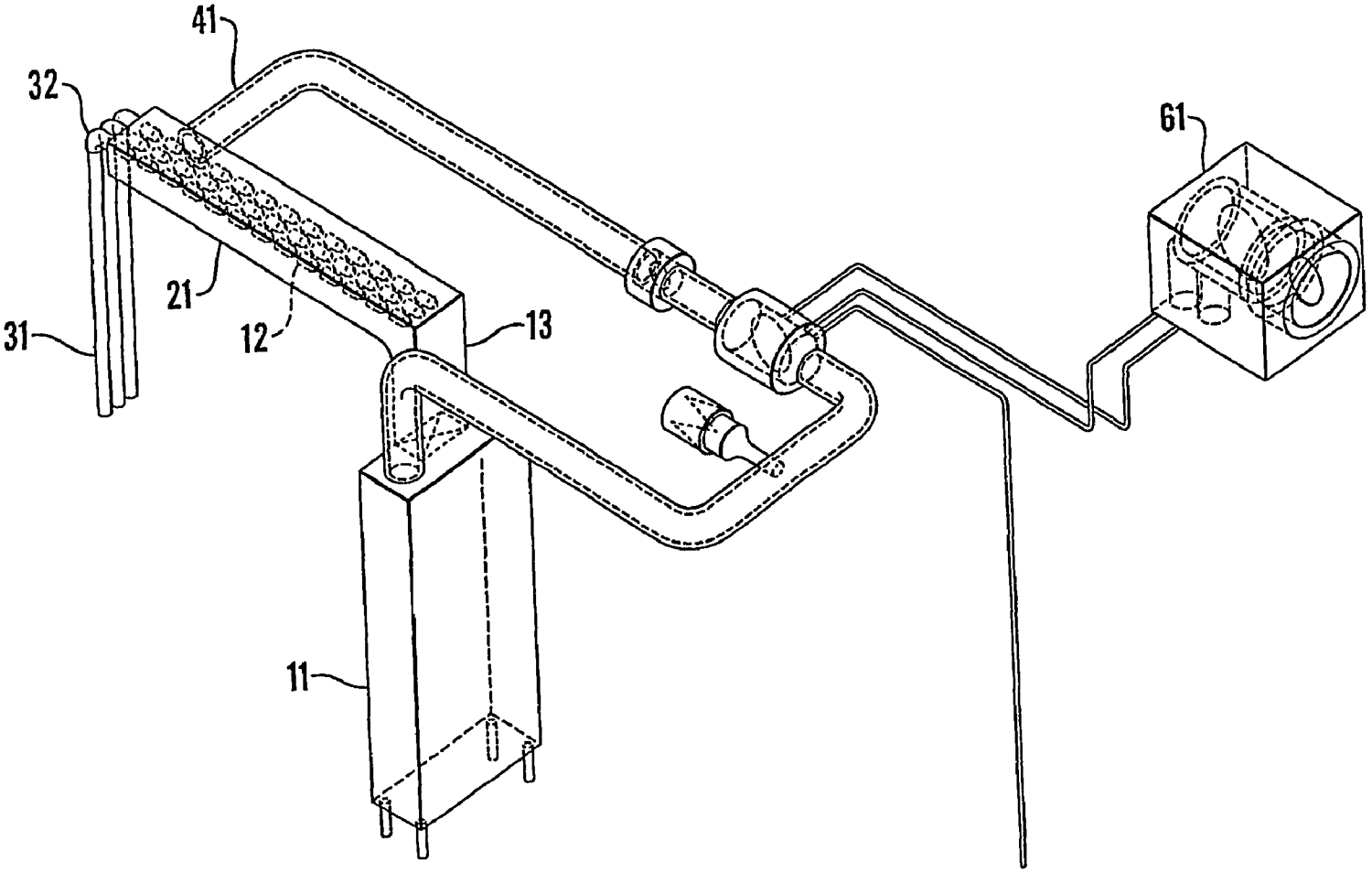

| | | | | | |
|---|---|---|---|---|---|
| 5,689,967 | A | | 11/1997 | Floysvik | |
| 5,725,124 | A | * | 3/1998 | Bustos et al. | 221/211 |
| 5,816,443 | A | * | 10/1998 | Bustos | 221/211 |
| 5,918,764 | A | * | 7/1999 | Bustos et al. | 221/211 |
| 6,039,510 | A | * | 3/2000 | Greene et al. | 406/21 |
| 6,164,491 | A | * | 12/2000 | Bustos et al. | 221/211 |
| 6,233,844 | B1 | * | 5/2001 | Gallego Juarez et al. | 34/401 |
| 6,322,295 | B1 | * | 11/2001 | Gabriele | 406/84 |

FOREIGN PATENT DOCUMENTS

| | | |
|---|---|---|
| EP | 0 410 138 | 1/1991 |
| EP | 0 409 693 | 6/1992 |
| EP | 0 862 878 | 9/1998 |
| GB | 2 247 068 | 2/1992 |
| WO | WO 99/63287 | 12/1999 |
| WO | WO 01/40088 | 6/2001 |

* cited by examiner

METHOD AND DEVICE FOR COOLING PRODUCTS IN A TRANSPORT SYSTEM

The invention relates to a method for cooling products contained in a transport system, a device for cooling products contained in a transport system, and a system in which the device is included.

In the retail trade it is desirable to be able to supply chilled products at specific locations, for example in a shop. It is particularly desirable to be capable of supplying chilled products such as canned and bottled drinks at defined, sales-promoting locations to which the customers' attention can easily be drawn, for example above or near a cash desk. Lack of space and aesthetic considerations make such locations unsuitable for installing a traditional storage and refrigeration unit, such as for example a refrigerator or refrigerated counter.

An initial task which forms the basis of the invention, therefore, is to provide a device for supplying chilled products in an area with limited space.

A number of different solutions to this initial task have previously been proposed.

One example is disclosed in U.S. Pat. No. 5,689,967, which describes a storage and cooling device for containers such as bottles and drinks cans. Here the containers are stored in a cylindrical storage area surrounding a vertical pipe. A fan blows cooled air upwards in the pipe. The cooled air then sinks down into the storage area where the containers are stored. Containers can be removed from the lowest part of the storage area. The air is passed on through openings in the bottom/wall of the storage area, and cooled by a cooling machine, whereupon it is circulated by the said fan. Condensation water is also drawn off through the said openings.

The device in the publication has the disadvantage that it takes up a relatively large amount of space. It is therefore not suitable for locations where the lack of space is critical, since it occupies floor space. A second disadvantage is that it has to be refilled manually in the same way as a traditional refrigerator or a refrigerated counter.

Another solution for supplying a chilled product to an area with limited space is described in U.S. Pat. No. 5,586,686. This publication concerns a pneumatically driven transport system where containers such as, e.g., bottles can be conveyed from a cooled store to a delivery unit in a shop. A product is ordered by a customer who is located at the delivery unit, and the product is transported through a pneumatic duct conveyor to the delivery unit. The system requires the product to be cooled in the store, and does not contain its own cooling means. Drawbacks of this system are that the transport through the duct conveyor entails a delay in delivery, and that the space occupied by the duct conveyor is not utilised as a store for the products.

The present invention is based on the technique described in WO-99/63287, assigned to the applicant. A transport system for chilled products such as cans and bottles is disclosed herein. The publication states that containers can be transported and stored in a duct system from a refrigerated store to a delivery unit installed in a shop. The duct system may contain cooling elements mounted in the duct walls in order to maintain a low temperature in the containers which are transported or are contained in the duct system. However, mounting cooling elements in the duct walls is a complicated and costly solution, with regard to both components, system construction and maintenance, where, during construction or alteration of the duct system, account must be taken of the fact that cooling elements have to be mounted and connected/removed.

EP-490 693 relates to a dispenser for, e.g., drinks cans, where it is stated that cooled air is circulated over a stack of cans by means of a fan. There is no indication that this solution permits chilled products to be supplied in an area with limited space, where the products are supplied from a feeder device, and where an external air cooling device is employed.

GB-2 247 068 discloses a container for storing articles such as drinks cans, where the cans are located in a chamber provided with a cooling machine with a fan, which disperses and circulates air round the cans. There is no indication in this solution either that it enables chilled products to be supplied in an area with limited space, where the products are supplied from a feeder device, and where an external air cooling device is employed.

EP-212 544 describes a cooling system in a delivery/sales dispenser for drinks containers, where the cooling device is especially arranged to cool the container which is next in line for delivery. If a number of containers are delivered over a short period of time, in all likelihood containers will be delivered which are not yet cooled.

An object of the present invention is to provide a device for cooling products contained in a transport system, comprising at least one lead-down duct with an upper and a lower portion, where the upper portion is arranged to be supplied with products from a feeder device, and where the lower portion comprises a product outlet, where the device does not have the above-mentioned drawbacks.

This object is achieved by having at least one lead-down duct connected at or near its upper portion with a supply channel for air provided from an external air cooling device, which lead-down duct is terminated at the lower portion by a termination piece with at least one exhaust opening, connected to a ventilating duct.

A second object of the invention is to provide a method for cooling products contained in a transport system, where the products are supplied to the upper portion of at least one lead-down duct from a feeder device, and where the products can be removed from an outlet comprised by the lower portion of the lead-down duct, and which does not have the above-mentioned drawbacks.

This object is achieved by having cooled air from an external air cooling device fed in at or near the lead-down duct's upper portion, the air being passed on from the lowest portion of the lead-down duct to a termination piece and from there to a ventilation duct.

A further object of the invention is to provide a system where a device according to the invention is included.

Further objects and advantages are achieved by means of the features which are set forth in the dependent claims.

The term lead-down duct in this context should be understood to include any elongated, hollow channel or profile, with an arbitrary cross section; where products can be contained and transported in the interior of the lead-down duct in a direction with a substantially downwardly directed, vertical component.

It is an advantage to prevent air which is discharged from the lead-down duct from cooling the environment near the product outlet. This advantage is achieved by having the lead-down duct terminated at the lower portion by a termination piece with at least one exhaust opening, connected to a ventilation duct.

It is a further advantage that the air which is discharged from the lead-down duct is recycled in the system. This advantage is achieved by having the ventilation duct directly or indirectly connected to the intake for the cooling device.

The ventilation duct preferably includes a fan device and is indirectly connected to the intake for the cooling device, being connected to the feeder device, which is further connected, possibly via other transport devices, to the intake for the cooling device.

Figure 2:
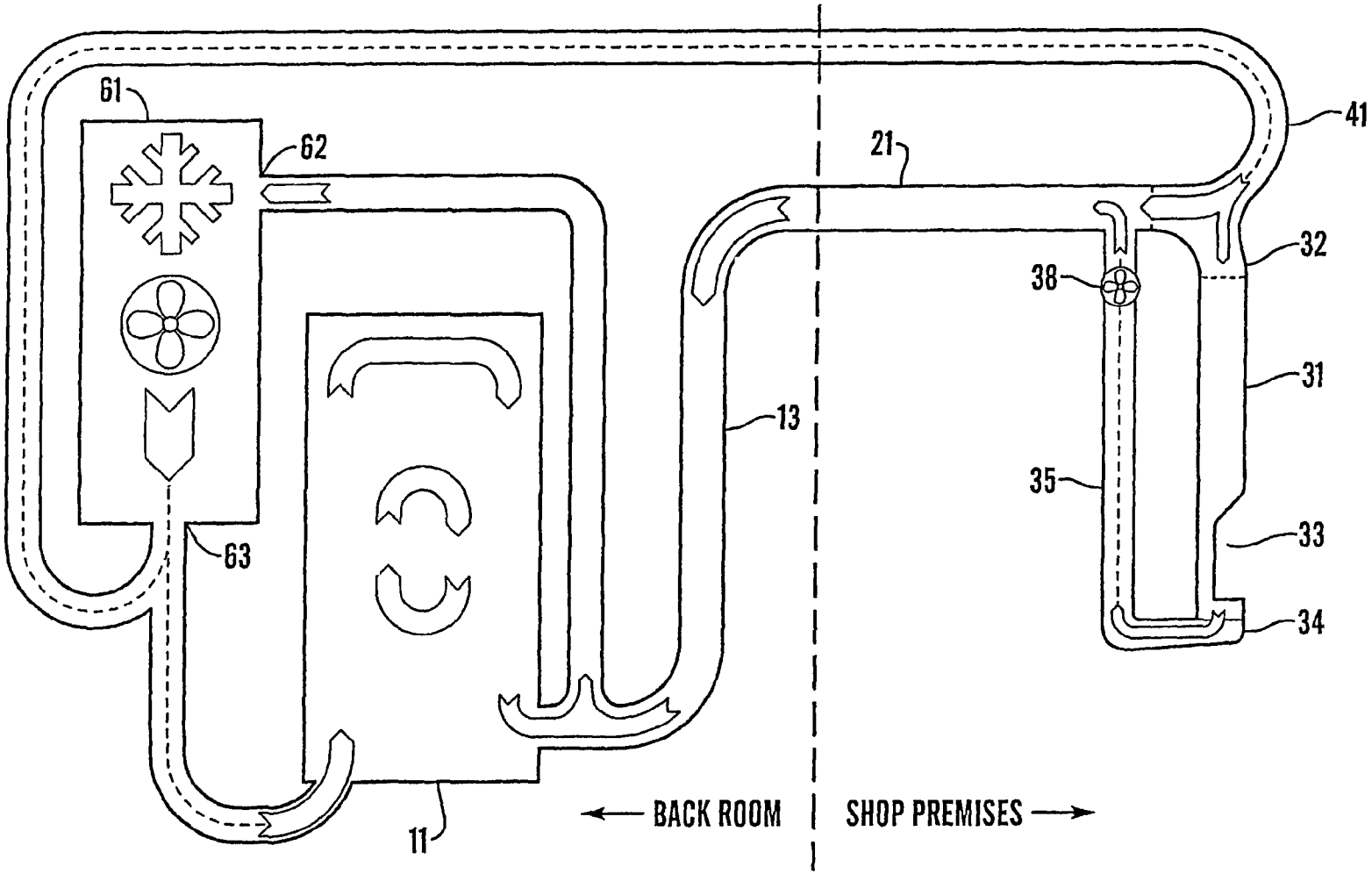
Figure 3:
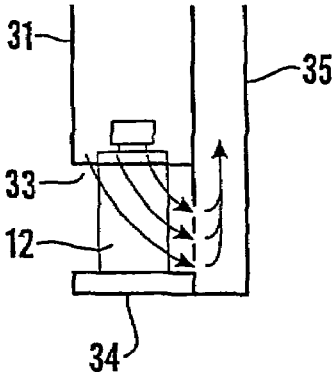
Figure 5:
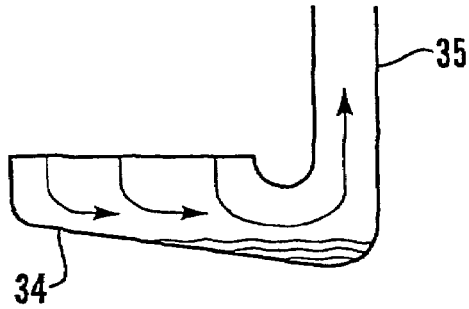
Figure 4:
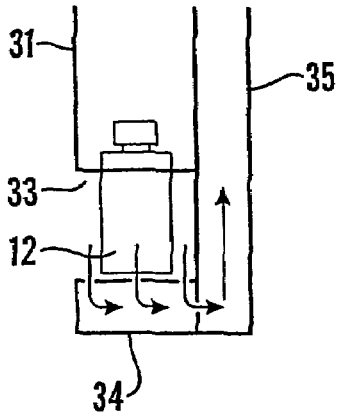
Figure 6:
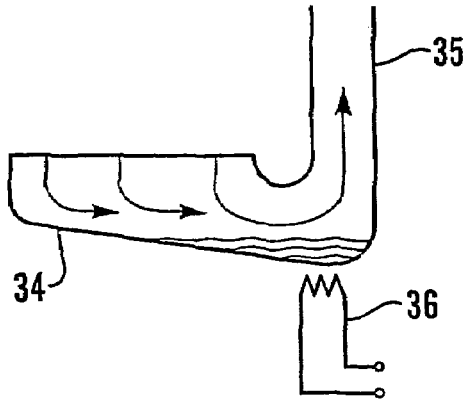

The invention will now be described in greater detail by means of an example, illustrated in the drawings, in which:

FIG. 1 is a perspective view illustrating a system for transport and cooling of products, where a device according to the invention is included, FIG. 2 is a schematic cross sectional view of a similar system for transport and cooling of products, where a device according to the invention is included, FIG. 3 is a cross sectional view of the lower part of a lead-down duct, FIG. 4 is a cross sectional view of an alternative lower part of a lead-down duct, FIG. 5 is a cross sectional view of a termination piece, FIG. 6 is a cross sectional view of an alternative termination piece.

FIG. 1 is a perspective view illustrating a system for storage, transport, cooling and delivery of products, where a device according to the invention is included.

The system comprises a storage device 11, arranged for storing a number of products 12. The products 12 are preferably drinks containers which are substantially cylindrical, and thereby have a main axis, a length and a largest diameter, and which also have a bottom portion and a top portion. It is particularly preferable that the products 12 are bottles or cans for drinks. Alternatively, the products 12 may comprise other products which should advantageously be delivered in a chilled state, such as for example foodstuffs, which preferably, but not necessarily are contained in an approximately cylindrical package or container.

A lifting transport device 13, which is not described in detail, but which can be provided by a person skilled in the art, is arranged to lift and convey products from the storage device 11 to a feeder device 21. The feeder device stores and transports the products substantially in a horizontal direction, at a first height level, which may advantageously be close to ceiling level. The products are preferably transported substantially close together in the products' axial direction, and with the bottom portion in the transport's direction of flow. The feeder device may comprise one or more parallel transport tracks. In the illustrated embodiment the feeder device is composed of three parallel transport paths, and is thereby suitable for transporting, for example, three different product types. The driving mechanism for the feeder device 21 is not illustrated in the figure, but may be composed of known per se conveyors, such as, for example, conveyor belts. Over shorter distances the products may be placed on a sliding or rolling track, abutting against one another in the transport direction, and the driving mechanism may be limited to a driving mechanism for the product which at any time is located at the rear, while the other products are pushed forward by the one at the rear.

At the downstream termination of the feeder device, each of the parallel transport tracks in the feed direction is connected with a lead-down duct 31. The lead-down duct is arranged to convey products to a second height level, which is lower than the first height level, and which is suitable for delivering the products. The lead-down duct is preferably substantially vertical, or possibly slanting or curved.

The lead-down duct 31 is preferably provided with lead-down devices (not shown) for controlled downward transport of the products. These may, for example, be composed of mechanical, electromechanical, hydraulic or pneumatic transport devices, which provide controlled downward transport of products one by one from the feeder device 21. The lead-down devices may comprise friction devices, where the weight of the products forms the motive power for the downward transport. The lead-down devices are arranged in such a manner that during normal operation the lead-down duct is at all times filled with products. This is achieved by having the feeder device arranged so as to supply a new product to the lead-down duct's upper part as soon as there is a vacant space for a product in the lead-down duct, and means that the lead-down duct is utilised for both storage and transport of products.

At or near the upper portion of the lead-down duct a supply channel 41 is connected for cooled air. In FIG. 1 the supply channel is connected to the feeder device 21, near the connection between the feeder device and the lead-down duct 31. The cooled air is supplied from an external air cooling device 61. The cooled air will partly be distributed inwards in the feeder device 21, against the direction of flow of the product transport in the feeder device, and partly downwards in the lead-down duct 31, in the direction of flow of the product transport in the lead-down duct.

Under normal circumstances the cooled air will have a lower temperature and thereby greater density than the air in the environment. The cooled air will therefore sink down in the lead-down duct, keeping the products located therein constantly cooled. With the device according to the invention, with lead-down ducts in which products are both stored, transported and cooled by the flow of air, good use is made of space, efficient cooling is obtained as well as the ability to deliver cooled products in areas with limited space, for example above a sales counter.

FIG. 2 illustrates a schematic cross sectional view of a system where a device according to the invention is included. Products are stored in the storage device 11, transported to a first height level by a lifting transport device 13, and conveyed by a substantially horizontal feeder device 21 to the lead-down duct 31. The arrows in FIG. 2 indicate directions for the airflow, not directions for transport of products.

The products arrive from the feeder device 21 at the lead-down duct 31 with the bottom portion first.

The feeder device 21 and the lead-down duct 31 are preferably connected to a connecting element 32, which has an angle designed to alter the substantially horizontal transport direction in the feeder device 21 to the substantially vertical transport device in the lead-down duct 31.

At or near the lead-down duct's upper portion there is connected a supply channel 41 for cooled air, supplied from an external air cooling device 61. In the embodiment in FIG. 2 the supply channel 41 is connected to the connecting element 32 between the feeder device 21 and the lead-down duct 31. The cooled air will partly be distributed inwards in the feeder device 21, against the direction of flow of the product transport in the feeder device, and partly downwards in the lead-down duct 31, in the direction of flow of the product transport in the lead-down duct.

At its lower portion the lead-down duct 31 has a product outlet 33. In FIG. 2 the outlet is constituted by an opening 33 in the lead-down duct's side wall. The opening 33 is adapted to the shape and size of the products 12 concerned.

FIG. 3 is a cross-sectional view of the lower portion of a lead-down duct 31. The outlet 33 in this case is composed of a gap between the lower part of the lead-down duct and a termination piece 34. The task of the termination piece here is to form a lower support for products arriving at the outlet 33, thereby preventing the products from falling out of the lead-down duct. The gap which forms the outlet 33 is obtained by having both the lead-down duct 31 and the termination piece 34 attached to a ventilation duct 35, parallel with the lead-down duct 31.

In order to prevent air flowing through the lead-down duct from leaking out into the environment, the device is advantageously equipped with vents, which collect the outflowing air and preferably return it to the air cooling device. This results in both a reduction in the cooling effect on the environment where the products are removed, and an increase in energy efficiency, since partly cooled air is returned to the air cooling device.

On the side facing the outlet 33, the ventilation duct 35 has a number of openings which constitute exhaust openings for the air flowing down through the lead-down duct for cooling the products. The ventilation duct is provided with an exhaust pump which draws air in through the openings and upwards in the ventilation duct.

The ventilation duct 35, moreover, may act as a support element for stiffening the lead-down duct 31. Even though the schematic view in FIG. 2 indicates that the lead-down duct 31 and the ventilation duct 35 are spaced at a distance apart, in a preferred embodiment the ventilation duct may be mounted against the lead-down duct, and be attached to the lead-down duct at several points. In addition the ventilation duct may contain equipment associated with the previously mentioned lead-down devices, particularly any driving mechanism for the lead-down devices.

FIG. 4 is a cross sectional view of an alternative lower part of a lead-down duct 31. This differs from the embodiment in FIG. 3 in that the termination piece 34 is provided with openings through which air can flow, before being fed into the ventilation duct 35.

FIG. 5 is a cross-sectional view illustrating a more detailed embodiment of a termination piece like that in FIG. 3. The termination piece consists of a cup-shaped U-tube device which collects down-flowing air and passes it up into the ventilation duct 35. The bottom of the termination piece is downwardly slanting towards a deepest point at the rear part where the ventilation duct extends vertically. By means of this design, any condensation water which may have been formed in the lead-down duct will be collected by the termination piece and passed to the deepest point, where the Ventilation duct extends vertically.

FIG. 6 shows that the termination piece may be equipped with a local heating element 36 for mounting in contact with the area around the deepest point in the termination piece. By supplying electric power to the heating element, this condensation water will be made to evaporate and will be removed together with the air which is drawn up in the ventilation duct 35.

FIG. 2 also illustrates that the air which is drawn up in the ventilation duct 35 is driven by means of a pump or fan 38. The air is then preferably introduced in the feed direction 21, and mixed with a part of the cooled air which is supplied to the feeder device 21 from the supply channel 41. After having passed the feeder device 21 and possibly the lifting transport device 13 opposite the products' transport direction, the air is passed on to the intake 62 on the air cooling device 61. Alternatively, the air from the ventilation duct 35 may be driven directly back to the intake 62 for the air cooling device 61.

The device according to the invention is particularly suitable for use in sales premises and shops, for delivering drinks containers in an area with limited space. It is therefore important to keep the temperature of the products supplied at an optimal level. It is particularly important to avoid the products being exposed to frost, and secondly it is important for them to be adequately cooled. An ideal temperature for the products at the outlet is around +4° C.

The air cooling device 61 may be an ordinary cooling unit, comprising a compressor and a fan which provides an outgoing flow of cooled air.

For controlling the refrigerating output, an on/off regulation, or a multi-step or alternatively stepless control of the compressor in the air cooling device may be employed. For example, use may be made of a double compressor or a compressor with a duplex winding motor, in order to obtain two steps in the compressor's output. Alternatively or in addition, the motor output of the fan may be employed to control the air volume per time unit for cooled air. In order to regulate the temperature of the products, the refrigerating output and/or the air volume may be controlled by means of a regulator device with feedback from temperature measurements provided by temperature sensors, which may be mounted in connection with the lead-down duct near or at the product outlet, or also in connection with the supply channel, thus enabling the regulation to also take account of the temperature there.

The outlet-33 for the lead-down duct may advantageously be provided with a closing device which closes the outlet, for example a removable or slidable cover (not shown). The object of the closing device is to close the outlet in a "night position" during the period in which products do not require to be available. This means that cold air is not discharged from the outlet during such periods, leading to a reduction in energy consumption.

The invention claimed is:

1. A method for cooling products contained in a transport system, where the products are fed into the upper portion of at least one lead-down duct (31) from a feeder device, and where the products can be removed from an outlet comprised by the lower portion of the lead-down duct (31),
characterized in that cooled air from an external air cooling device (61) is fed in at or near the lead-down duct's (31) upper portion, and that the air is passed on from the lowest portion of the lead-down duct to a termination piece (34) and from there to a ventilation duct (35).

2. A method according to claim 1,
characterized in that the air is passed directly or indirectly via the ventilation duct (35) to the intake (62) for the cooling device (61).

3. A method according to claim 2,
characterized in that the air in the ventilation duct (35) is driven by a fan device (38), and it is passed from the ventilation duct (35) indirectly to the intake (62) for the cooling device (61), being passed to the feeder device (21), and on from there, possibly via other transport devices, to the intake (62) for the cooling device (61).

4. A device for cooling products (12) contained in a transport system, comprising at least one lead-down duct (31) with an upper and a lower portion, where the upper portion is arranged to be supplied with products from a feeder device (21), and where the lower portion comprises a product outlet (33), characterized in that at least one lead-down duct (31) is connected at or near its upper portion with a supply channel (41) for air provided from an external air cooling device (61), which lead-down duct (31) is terminated at the lower portion by a termination piece (34) with at least one discharge opening connected to a ventilation duct (35).

5. A device according to claim 4, characterized in that the ventilation duct (35) is directly or indirectly connected to the intake (62) for the cooling device (61).

6. A device according to claim 5, characterized in that the ventilation duct (35) comprises a fan device (38), and that it is indirectly connected to the intake (62) for the cooling device (61), being connected to the feeder device (21), which is further connected, possibly via other transport devices, to the intake (62) for the cooling device (61).

7. A device according to claim 4, characterized in that the ventilation duct (35) is mounted substantially parallel with the lead-down duct (31).

8. A device according to claim 7, characterized in that the ventilation duct is mounted substantially along and attached to the lead-down duct.

9. A device according to claim 4, characterized in that the termination piece (34) comprises a cup-shaped collecting device which covers the lower opening of the lead-down duct (31).

10. A device according to claim 4, characterized in that the lead-down duct (31) is substantially vertical.

11. A device according to claim 4, characterized in that the lead-down duct (31) comprises an inner duct and an outer duct, with an air-filled space for insulation purposes.

12. A device according to claim 4, characterized in that the lead-down duct (31) contains on its inner duct wall longitudinal guide tracks for guiding the products and for preventing wear on the duct wall's inner surface.

13. A device according to claim 4, characterized in that at least a part of the lead-down duct (31) is made of a transparent material.

14. A device according to claim 4, characterized in that the outlet is arranged to be able to be closed by a closing device.

15. A system for storage and transport, cooling and delivery of products, characterized in that it comprises a device according to claim 4.

* * * * *